US007895845B2

(12) United States Patent
Every et al.

(10) Patent No.: US 7,895,845 B2
(45) Date of Patent: Mar. 1, 2011

(54) ADAPTIVE DEFROST CONTROL FOR FROZEN PRODUCT DISPENSERS

(76) Inventors: Steve Every, Hawthorn Woods, IL (US); John F. Paulius, III, Algonquin, IL (US); David B. Gist, Grayslake, IL (US); Santhosh Kumar, Woodridge, IL (US); Gregory M. Billman, Buffalo, MN (US); Daniel C. Leaver, Westmont, IL (US); Kyle B. Elsom, Batavia, IL (US); Nikolay Popov, Warrenville, IL (US)

( * ) Notice: Subject to any disclaimer, the term of this patent is extended or adjusted under 35 U.S.C. 154(b) by 524 days.

(21) Appl. No.: 12/004,590

(22) Filed: Dec. 21, 2007

(65) Prior Publication Data

US 2008/0223049 A1 Sep. 18, 2008

Related U.S. Application Data

(60) Provisional application No. 60/877,593, filed on Dec. 28, 2006.

(51) Int. Cl.
*A23G 9/00* (2006.01)

(52) U.S. Cl. ..... 62/81; 62/151; 62/155; 62/208; 62/233; 62/342

(58) Field of Classification Search ..... 62/80–82, 62/151–152, 155–156, 208–209, 233, 342–343
See application file for complete search history.

(56) References Cited

U.S. PATENT DOCUMENTS

| | | | | |
|---|---|---|---|---|
| 3,653,223 | A * | 4/1972 | Jones et al. | 62/160 |
| 4,201,558 | A * | 5/1980 | Schwitters et al. | 62/70 |
| 4,563,880 | A * | 1/1986 | Cipelletti | 62/234 |
| 4,680,940 | A * | 7/1987 | Vaughn | 62/155 |
| 4,827,732 | A * | 5/1989 | Suyama et al. | 62/233 |
| 4,869,072 | A * | 9/1989 | Sexton et al. | 62/136 |
| 5,158,506 | A * | 10/1992 | Kusano et al. | 62/136 |
| 6,220,047 | B1 * | 4/2001 | Vogel et al. | 62/342 |
| 6,606,870 | B2 * | 8/2003 | Holmes et al. | 62/155 |

* cited by examiner

*Primary Examiner*—William E Tapolcai
(74) *Attorney, Agent, or Firm*—Pyle & Piontek LLC

(57) ABSTRACT

An adaptive defrost control for a frozen product machine implements an algorithm that utilizes various operating parameters of the machine to adaptively adjust the time interval between successive defrost cycles in a manner such that defrost cycles occur only on an as-needed basis. The adaptive defrost control minimizes the time during which the machine is in a defrost cycle, thereby maximizing the uptime of the machine during which frozen product can be prepared.

18 Claims, 13 Drawing Sheets

ADAPTIVE DEFROST CONTROL FOR FROZEN PRODUCT DISPENSERS

This application claims benefit of provisional patent application Ser. No. 60/877,593, filed Dec. 28, 2006.

FIELD OF THE INVENTION

The present invention relates to machines for making and dispensing frozen beverage products, and in particular to an adaptive defrost control for a frozen product dispenser.

BACKGROUND OF THE INVENTION

Frozen beverage product machines, such as frozen carbonated beverage (FCB) machines, traditionally utilize a time based defrost control that is periodically implemented due to build-up of ice particles in the beverage product within a freeze barrel. A defrost schedule may be manually programmed in the machine, with defrost cycles occurring either automatically according to predetermined time periods, or manually as ice particles are viewed in the dispensed beverage product and defrosting is deemed necessary. Typically, defrost cycles occur at fixed intervals, usually every 3 to 4 hours, but this approach does not take into consideration whether defrosting is actually necessary, and during defrost the machine is "down" and frozen beverage is not available for service to customers. Since "up time", during which frozen beverage product is available for service from the machine, is very important to the user, it would be desirable to have a defrost control that puts the machine into a defrost cycle only as often as is necessary and only on an as-needed basis, thereby to increase the uptime of the machine and the amount of frozen beverage product that may be served, and also to enhance value and energy savings.

OBJECTS OF THE INVENTION

An object of the present invention is to provide an adaptive defrost control for a frozen beverage dispenser, which adaptively adjusts the time between defrost cycles in a manner such that defrost occurs only on an as-needed basis.

Another object is to provide such an adaptive defrost control that monitors one or more parameters of the frozen beverage dispenser and initiates a defrost cycle based upon the values of such one or more parameters.

SUMMARY OF THE INVENTION

In accordance with the present invention, a frozen product dispenser, comprises a freeze barrel; means for delivering liquid product to the freeze barrel; a refrigeration system operable in a chilling cycle to freeze product in the freeze barrel; means for defrosting product in the barrel; and means responsive to at least one operating parameter of the frozen product dispenser for adaptively controlling and adjusting the times between operations of the means for defrosting.

In one embodiment, the refrigeration system is operable in a defrost cycle to defrost product in the freeze barrel, and the means for defrosting comprises means for operating the refrigeration system in defrost cycles. In another embodiment, the means for defrosting comprises an electric heater that is operable to defrost product in the freeze barrel, and the means for defrosting comprises means for operating the electric heater.

Among the operating parameters to which the means for adaptively controlling is responsive is product throughput per unit time through the frozen beverage machine.

The invention also contemplates a method of operating a frozen product dispenser, the method comprising the steps of delivering liquid product to a freeze barrel; operating a refrigeration system in a chilling cycle to freeze product in the freeze barrel; sensing the value at least one operating parameter of the frozen product dispenser; defrosting product in the freeze barrel; and adaptively controlling and adjusting the times between performance of the defrosting step in accordance with the sensed value of the at least one operating parameter of the frozen product dispenser.

According to one aspect of the method, the refrigeration system is also operable in a defrost cycle to defrost product in the freeze barrel, and the defrosting step is performed by operating the refrigeration system in a defrost cycle. According to another aspect, the defrosting step is performed by energizing an electric heater to heat the freeze barrel.

Among the values of the operating parameters sensed is product throughput per unit time through the frozen product dispenser.

DETAILED DESCRIPTION

The invention provides a novel adaptive defrost control for a frozen product dispenser or machine, such that the refrigeration system of the dispenser is operated to defrost product in a freeze barrel of the dispenser only on an as-needed basis. As compared to the conventional technique of running the dispenser through defrost cycles that are programmed to occur at set intervals, during which time the freeze barrel of the dispenser does not produce frozen product, the defrost control of the invention decreases the downtime and increases the uptime of the dispenser, thereby increasing the total output of frozen product available from the dispenser. While an adaptive defrost control as taught by the invention may advantageously be used in various diverse applications, a presently contemplated use for such a control is in providing cooling for a frozen carbonated beverage (FCB) dispenser, and the invention will therefore be described in terms of that environment.

Figure 1:
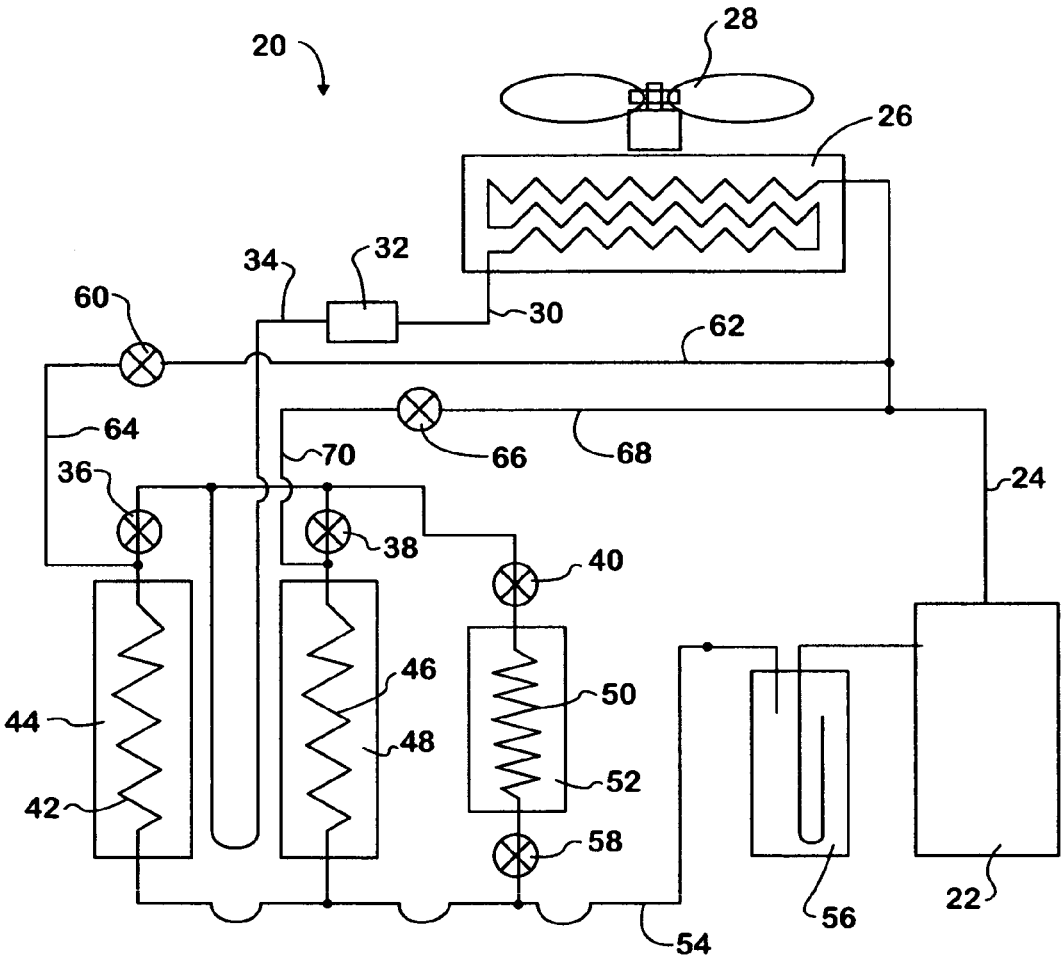
FIG. 1 is a schematic representation of a refrigeration system of a type that may be used to chill each of two product freeze barrels and a pre-chiller of a frozen product dispenser, with which the adaptive defrost control of the present invention may advantageously be used.

Referring to FIG. 1, a refrigeration system of a type as may be used with an FCB dispenser and operated in defrost cycles according to the adaptive defrost control of the invention is indicated generally at 20. The refrigeration system may be of a type as is used in practice of a prescriptive refrigerant flow control as disclosed in co-pending application Ser. No. 11/983,162, filed Nov. 7, 2007, the teachings of which are incorporated herein by reference. The refrigeration system includes a variable speed/capacity compressor 22 that may be a scroll or a reciprocating compressor that is provided with a variable-frequency drive for applying to an ac motor of the compressor an ac voltage signal having a frequency selected to provide a desired speed of operation of the motor and, thereby, a desired output capacity of the compressor. Alternatively, for the purposes of the present invention, the compressor can be a single speed compressor. In any event, hot refrigerant at an outlet from the compressor is coupled through a refrigerant line 24 to an inlet to a condenser 26, through which air is drawn by a fan 28 to cool the refrigerant. Cooled refrigerant at an outlet from the condenser flows through a refrigerant line 30 to and through a filter/dryer 32 and a refrigerant line 34 to inlets to each of three electronically controlled expansion valves 36, 38 and 40 that may be of the stepper motor driven or pulse valve modulated type, such that the valves may be controlled to meter selected refrigerant flows from their outlets. Refrigerant exiting an outlet from the expansion valve 36 is delivered to an inlet to an evaporator coil 42 that is heat transfer coupled to a first beverage product freeze barrel 44 of an FCB dispenser to chill the barrel and freeze beverage product in the barrel. Refrigerant exiting an outlet from the expansion valve 38 is delivered to an inlet to an evaporator coil 46 that is heat transfer coupled to a second beverage product freeze barrel 48 of the dispenser to chill the barrel and freeze beverage product in the barrel. Refrigerant exiting an outlet from the expansion valve 40 is delivered to an inlet to an evaporator coil 50 that is heat transfer coupled to a pre-chiller 52 of the dispenser to chill the pre-cooler and, as will be described, to chill beverage product flowed through the pre-chiller before being introduced into the barrels 44 and 48. After passing through each of the barrel evaporators 42 and 46, refrigerant exiting outlets from the evaporators flows through a refrigerant line 54 and an accumulator 56 to an inlet to the compressor 22. After passing through the pre-cooler evaporator 50, refrigerant exiting the evaporator flows through an evaporator pressure regulating valve 58 and then through the refrigerant line 54 and accumulator 56 to the inlet to the compressor. The evaporator pressure regulating valve 58 serves to prevent the pressure of refrigerant in the evaporator 50 from falling below a lower limit, thereby to prevent freezing of beverage product in the pre-cooler 52.

The refrigeration system 20 has two defrost circuits, a first one of which is for defrosting the freeze barrel 44 and includes a solenoid operated refrigerant valve 60 having an inlet coupled directly to hot refrigerant at the outlet from the compressor 22 through a refrigerant line 62 and an outlet coupled to the inlet to the freeze barrel evaporator 42 through a refrigerant line 64. A second defrost circuit is for defrosting the freeze barrel 48 and includes a solenoid operated refrigerant valve 66 having an inlet coupled directly to hot refrigerant at the outlet from the compressor 22 through a refrigerant line 68 and an outlet coupled to the inlet to the freeze barrel evaporator 46 through a refrigerant line 70. The defrost circuits are operated to heat the evaporators 42 and 46 to defrost the beverage product barrels 44 and 48 in defrost cycles of the refrigeration system. When the refrigeration system is operating to chill the product freeze barrel 44, the refrigerant valve 60 is closed and the expansion valve 36 is open to meter refrigerant to the evaporator 42, and when the refrigeration system is being operated in a defrost mode to defrost product in the freeze barrel 44, the refrigerant valve 60 is open and the expansion valve 36 is closed. Similarly, when the refrigeration system is operating to chill the product freeze barrel 48, the refrigerant valve 66 is closed and the expansion valve 38 is open to meter refrigerant to the evaporator 46, and when the refrigeration system is being operated in a defrost mode to defrost product in the freeze barrel 48, the refrigerant valve 66 is open and the expansion valve 38 is closed.

Figure 2:
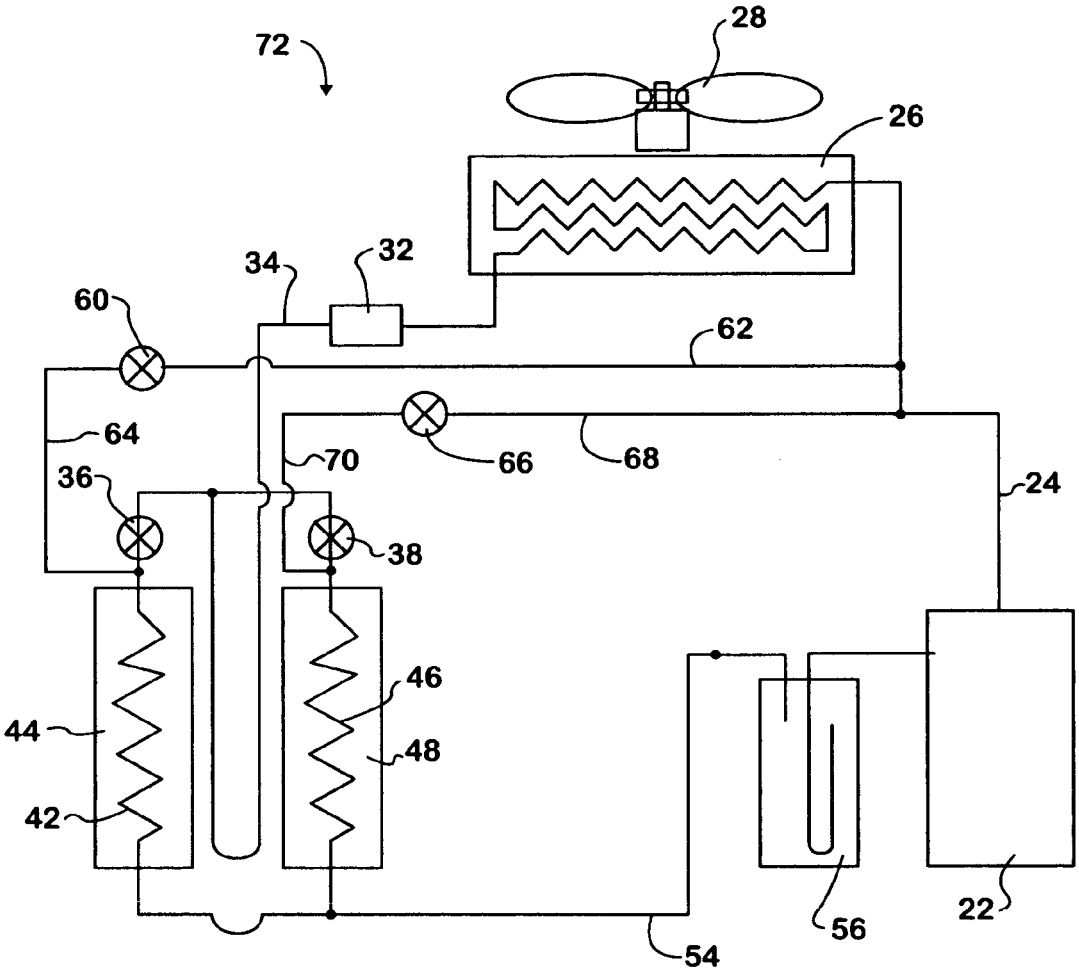
FIG. 2 is similar to the system of FIG. 1, except that the refrigeration system does not provide chilling for a pre-chiller.

The refrigeration system 20 is adapted for use with an FCB dispenser that has a pre-chiller 52. To provide chilling for an FCB dispenser that does not have a pre-chiller, a refrigeration system of a type shown in FIG. 2 and indicated generally at 72 may be used. The refrigeration system 72 is similar to the refrigeration system 20, and like reference numerals have been used to denote like components. A difference between the two systems is that since the system 72 does not provide for cooling of a pre-chiller 52, it does not have an evaporator coil 50, an electronically controlled expansion valve 40 and an evaporator pressure regulating valve 58. Otherwise, the structure and operation of the two refrigeration systems 20 and 72 are similar.

It is to be understood that while each of the refrigeration systems 20 and 72 are structured to provide chilling for two product freeze barrels, since that enables two different flavors of frozen beverages to be prepared by a frozen beverage product machine, the teachings of the invention may also be used with a refrigeration system that chills only a single product freeze barrel, or with one that chills more than two product freeze barrels.

The adaptive defrost control of the invention may be embodied in an FCB dispenser having either type of refrigeration system 20 or 72, or for that manner in an FCB dispenser having generally any type of refrigeration system, without there being significant differences in the manners in which the adaptive defrost control determines when the refrigeration system is to be operated in defrost cycles. For convenience, however, the invention will be described in terms of its use in controlling the occurrence of defrost cycles of the refrigeration system 20.

Figure 3:
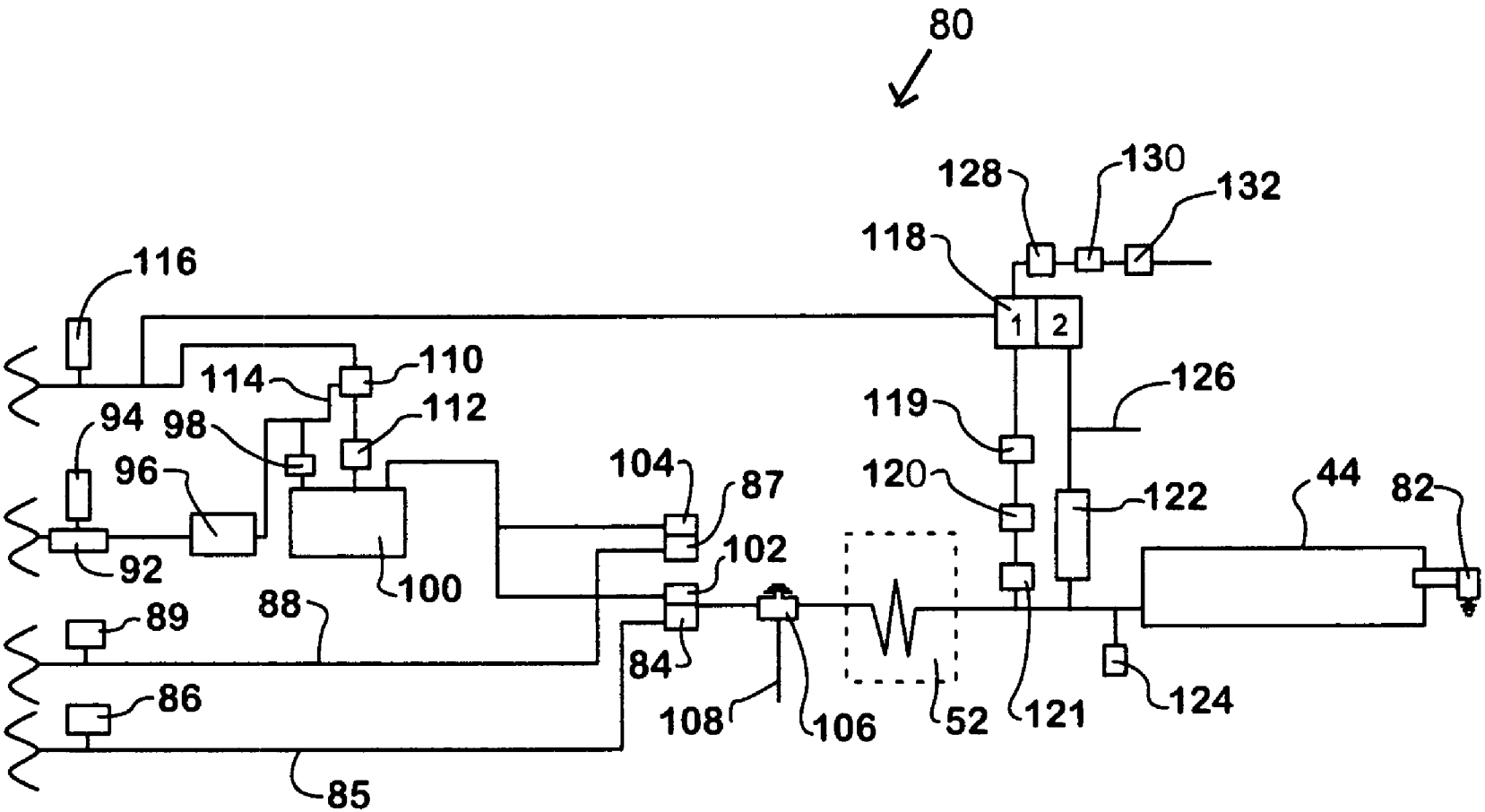
FIG. 3 is a schematic representation of one possible type of frozen beverage dispensing system having both two beverage product freeze barrels and a pre-chiller that may be chilled by a refrigeration system embodying the adaptive defrost control of the present invention.

One embodiment of FCB dispenser that may utilize the refrigeration system 20 and with which the adaptive defrost control of the invention may advantageously be used is shown in FIG. 3 and indicated generally at 80. The dispenser includes the two beverage product freeze barrels 44 and 48, only the barrel 44 being shown. This particular embodiment of FCB dispenser utilizes ambient temperature carbonation, and while not specifically shown in FIG. 3 (but shown in FIG. 1), it is understood that the evaporator coil 42 is heat transfer coupled to the barrel 44 to chill the barrel in order to freeze beverage product mixture introduced into the barrel. With reference to the portion of the dispenser 80 shown and associated with the freeze barrel 44, it being understood that a like description applies to a similar but less than fully shown portion of the dispenser associated with the freeze barrel 48, a frozen beverage product dispensing valve 82 is coupled to the barrel 44 for service of frozen beverages to customers. To deliver liquid beverage components to the barrel 44 for being frozen, an externally pumped beverage syrup concentrate is delivered to an inlet to a syrup brixing valve 84 through a syrup line 85, to which line is coupled a sensor 86 for detecting a syrup-out condition. To deliver liquid beverage components to the barrel 48 (shown in FIG. 1), an externally pumped beverage syrup concentrate is delivered to an inlet to a syrup brixing valve 87 through a syrup line 88, to which line is coupled a sensor 89 for detecting a syrup-out condition. A potable water supply, such as from a city main, is connected to the dispenser through a strainer/pressure regulator 92, to which is coupled a pressure switch 94 for detecting a water-out condition. From the strainer/pressure regulator the water passes through a carbonator pump 96 and a check valve 98 to a water inlet to a carbonator 100. The carbonator 100 operates in a manner well understood in the art to carbonate water introduced therein, and carbonated water at an outlet from the carbonator is delivered both to an inlet to a water brixing valve 102 associated with the syrup brixing valve 84 and to an inlet to a water brixing valve 104 associated with the syrup brixing valve 87. The brixing valves 104, 87 comprise an associated pair of brixing valves that deliver a water and syrup mixture, in a selected and adjustable ratio, through an associated fluid circuit (not shown) that includes the pre-chiller 52, to the freeze barrel 48. The brixing valves 102, 84 also comprise an associated pair of brixing valves that deliver a water and syrup mixture, in a selected and adjustable ratio, through an associated fluid circuit that includes the pre chiller 52, to the freeze barrel 44. The water and syrup beverage mixture provided at an outlet from each pair of brixing valves is in a ratio determined by the settings of the individual valves of each pair, and the mixture passed though the of brixing valves 102, 84 is delivered through a 3-way valve 106 and the pre-chiller 52 to the freeze cylinder or barrel 44, it being understood that, although not shown (but shown in FIG. 1), the evaporator coil 50 is heat exchange coupled to the pre-chiller. The 3-way valve 106 has an outlet 108 leading to atmosphere, by means of which a sample of the water and syrup mixture output by the pair of brixing valves 102 and 84 may be collected for analysis, so that any necessary adjustments may be made to the brixing valves to provide a desired water/syrup ratio.

To carbonate water in the carbonator tank 100, an externally regulated supply of $CO_2$ is coupled through a temperature compensated pressure regulator 110 and a check valve 112 to the carbonator, the regulator 110 including a capillary sensor 114 for detecting the temperature of incoming water. A sensor 116 detects a $CO_2$-out condition, and the supply of $CO_2$ is also coupled to inlets to each of two $CO_2$ pressure regulators of a manifold 118. An outlet from a first one of the manifold pressure regulators is coupled through a solenoid shut-off valve 119, a $CO_2$ flow control valve 120 and a $CO_2$ check valve 121 to an inlet to the freeze barrel 44. In addition, $CO_2$ at an outlet from a second one of the manifold pressure regulators is coupled to an upper opening to an expansion tank 122, a lower opening to which is coupled to the water and syrup mixture line between the pre-chiller and freeze barrel. The flow control valve 120 accommodates adjustment of the carbonation level in the barrel 44 by enabling the introduction of $CO_2$ into the barrel for a brief period before a mixture of water and syrup is delivered into the barrel. A pressure transducer 124 monitors the pressure of the water and syrup mixture in the barrel 44 and serves as a pressure cut-in/cut-out sensor to control filling and refilling of the barrel with liquid beverage product to be frozen in the barrel. As is understood by those skilled in the art, when the pressure transducer 124 detects a lower limit cut-in pressure in the barrel, for example 23 psi, the pair of brixing valves 102, 84 is opened for flow of a water and syrup mixture to and into the barrel to refill the barrel, until the pressure transducer detects an upper limit cut-out pressure, for example 29 psi, whereupon the pair of brixing valves is closed. During flow of the water and syrup mixture to the barrel, the mixture is cooled as it flows through an associated circuit in the pre-chiller 52. As the beverage mixture is frozen in the barrel 44 it expands, and the expansion chamber 122 accommodates such expansion.

As mentioned, the dispenser 80 includes the freeze barrel 48 and, therefore, includes further structure (not shown) that is generally duplicative of that to the right of the pair of brixing valves 102, 84 and that accommodates delivery of a water and syrup mixture from the pair of brixing valves 104, 87 to the barrel 48, except that the beverage mixture does not flow through a separate pre-chiller, but instead flows through an associated circuit of the pre-chiller 52. In addition, a line 126 delivers $CO_2$ to an upper opening to an expansion chamber, a lower opening from which expansion chamber couples to an inlet to the barrel 48, and to accommodate addition of $CO_2$ to the barrel 48, the outlet from the manifold first $CO_2$ pressure regulator is also coupled through a solenoid shut-off valve 128, a $CO_2$ flow control valve 130 and a $CO_2$ check valve 132 to the inlet to the barrel.

In operation of the FCB machine 80, liquid beverage components are introduced through the pre-chiller and into the freeze barrels 44 and 48 by their respective pairs of brixing valves 84, 102 and 87, 104. The refrigeration system 20 provides chilling for the pre-chiller 52 via the heat transfer coupled evaporator 50, so that the liquid beverage components delivered into the freeze barrels 44 and 48 are chilled. The refrigeration system also provides chilling for the freeze barrels 44 and 48 via the respective heat transfer coupled evaporators 42 and 46, to freeze the liquid beverage components in the barrels while the components are agitated by a beater/scraper bar (not shown), all in a manner well understood by those skilled in the art. Frozen beverage product prepared within the freeze barrels is dispensed for service to customers, such a by the dispense valve 82 coupled to the freeze barrel 44.

Frozen beverage product machines typically have a time based defrost cycle that is implemented at fixed intervals due to build-up of beverage product ice particles in the freeze barrel(s). The defrost cycles normally occur automatically, according to a predetermined fixed frequency or time period, although means may be provided to manually initiate a defrost cycle. Typically, defrost cycles are programmed to automatically occur about every 3 to 4 hours, but this approach does not take into account whether a defrost cycle is actually needed at the end of the period, and during defrost the frozen beverage machine is "down" and frozen beverage product is not available for service to customers. Since machine "up time" is very important, it is best not to enter a defrost cycle unless defrost is actually necessary. The invention therefore provides an adaptive defrost control that puts the machine into a defrost cycle only if and as necessary, and only on an as-needed basis, to thereby decrease machine downtime, increase machine uptime, increase the amount of frozen beverage product that may be served from the machine, and enhance value and energy savings.

The present invention overcomes the deficiencies of the prior art approach of controlling defrost cycles of an FCB machine to occur at predetermined fixed intervals. In so improving, the invention provides an adaptive defrost control for a frozen product machine, which adaptively adjusts the time intervals between product defrost cycles of a refrigeration system of the machine, in such a manner as to defrost the machine only as necessary and only on an as-needed basis, thereby to increase machine uptime and frozen product output. The adaptive defrost control is implemented by monitoring various parameters of the FCB machine, which parameters are indicative of a need to defrost a freeze barrel, and by initiating a defrost cycle based upon a concurrence or correlation of the values of a selected one or more of the parameters, rather than simply based upon a fixed time interval.

The invention is predicated upon a recognition that there are a number of factors involved in operation of a frozen beverage product machine that have a direct influence upon a need to defrost product in the freeze barrels, and that an actual need to enter a defrost cycle does not necessarily occur at set intervals. The variable that is controlled in implementation of the adaptive defrost control of the invention is a time tD between defrost cycles, i.e., the time interval or duration from the end of one defrost cycle until the beginning of the next defrost cycle, and there are several variable parameters that in operation of the FCB machine determine a need for defrost and, therefore, influence the value of tD. These variable parameters are listed in the table below; along with the manner in which each influences the time tD between defrost cycles. The primary parameter that influences the value of tD is beverage product throughput or usage, since if a significant amount of beverage product is drawn through the machine on a unit time basis, the need for defrost becomes non-existent. This factor, along with other factors that influence a need for execution of a defrost cycle, are as follows:

| Factors Affecting the Time tD between Defrost Cycles | The Influence of each Factor on the Time tD |
|---|---|
| Beverage product usage or throughput | Beverage product throughput to a freeze barrel may be represented by the time for which its brix valves are actuated or opened, since the flow rate of beverage product through the actuated valves is known, and the time of actuation of the brix valves can be averaged over a period of time. High throughput of beverage product negates a need for frequent defrost of the freeze barrel and increases the time tD. On the other hand, low throughput, such as less than 128 oz of finished drink in a 3-hr period, requires execution of a defrost cycle about every 3 hours. |
| Time duration of the last defrost cycle | If the time required during the last defrost cycle to reach a selected freeze barrel evaporator outlet temperature was less than a target time Tt, then the time tD to execution of the next defrost cycle is increased. |
| Maximum evaporator outlet temperature reached during the last defrost cycle | If a defrost cycle is terminated because the target time Tt expired before the selected freeze barrel evaporator outlet temperature was reached, the time to the next defrost cycle is decreased. |
| Viscosity setting for product in freeze barrel | If VISC $\geqq$ 4, the beverage product in a freeze barrel is colder and icier, requiring more frequent defrosts and decreasing the time tD.<br>If VISC < 4, the beverage product is warmer and more watery, requiring less frequent defrosts and increasing the time tD. |
| Brix valves setting | A brix valve setting that is less than 13 +/− 1% requires more frequent defrosts and decreases the time tD. |
| Product type | Sugar-based products require less frequent defrosts since sugar acts as an anti-freeze, so tD can be increased. Diet syrups require more frequent defrosts and a decrease in tD. |
| Ambient temperature | Higher ambient temperatures result in increased heat gain through the walls of a freeze barrel, requiring more frequent defrosts and a decrease in tD. Lower ambient temperatures require less frequent defrosts and an increase in tD. |
| Power supply frequency | 50 Hz applications require 16% more defrost cycle time, but since the refrigeration system will have less cooling capacity, less frequent defrosts may be required with an increase in tD. |
| Number of refrigeration system compressor cycles | More compressor cycles indicates that less beverage product is being moved through the system, requiring more frequent defrost cycles and a decrease in the value of tD. Fewer compressor cycles mean that more beverage is being moved through the system, requiring fewer defrost cycles and an increase in the value of tD. |
| Refrigeration compressor run time | More compressor run time is required when there is more beverage product moved through the machine, requiring fewer defrost cycles and an increase in the value of tD. Less compressor run time occurs when there is less beverage product moved through the machine, requiring more defrost cycles and a decrease in the value of tD. |

-continued

| Factors Affecting the Time tD between Defrost Cycles | The Influence of each Factor on the Time tD |
|---|---|
| Product ratio | More concentrated products (greater syrup/water ratio) require less frequent defrosts, so tD is increased. Less concentrated products require more frequent defrosting, so tD is decreased. |

The primary factor affecting the time interval tD between defrost cycles, i.e., the factor that changes the value of tD the most, is product throughput, which is proportional to the number of times the brix valves are activated to deliver beverage product to a freeze barrel 44 or 48, multiplied by the average on-time of the brix valves per activation. In other words, the total mass flow of beverage product to a freeze barrel is determined by:

Product throughput=# brix valve activations×average on-time per activation.

Figure 4:
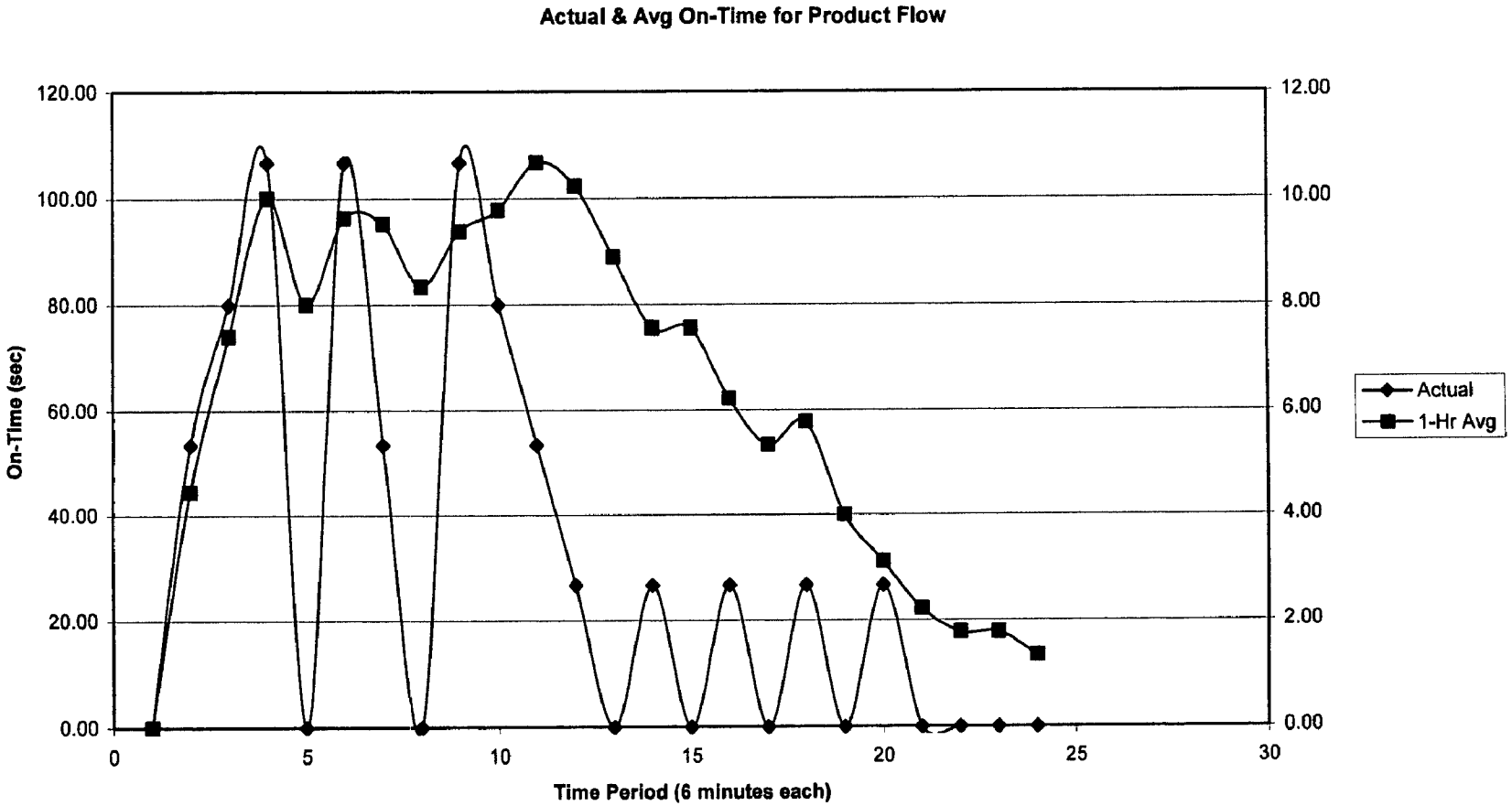
FIG. 4 is a graph of actual and 1-hour average brix valve on-time versus time for a frozen beverage product machine.

Total beverage product throughput to an individual one of the freeze barrels 44 and 48 is tallied by counting the number of times the brix valves are activated to deliver beverage product to that freeze barrel, and by accumulating the on-time associated with those activations over a window of time, such as over a 1-hour time history. The average on-time of a pair of brix valves may increase or decrease over the window of time, and the time tD between defrosts is adjusted accordingly, i.e., as average on-time increases, tD is increased, and as average on-time decreases, tD is decreased. It is desirable to monitor average on-time, following a defrost cycle, based upon a 1-hour rolling average, such for example as is shown in FIG. 4, which graphically illustrates a representative example of actual and average brix valve on-times for various product flows. For the first hour following defrosting of a freeze barrel, product throughput to that barrel is monitored based upon a 1-hour rolling average, after which first hour, and until the beginning of the next product defrost cycle for that barrel, product throughput is monitored based simply upon a 1-hour average.

Figure 5:
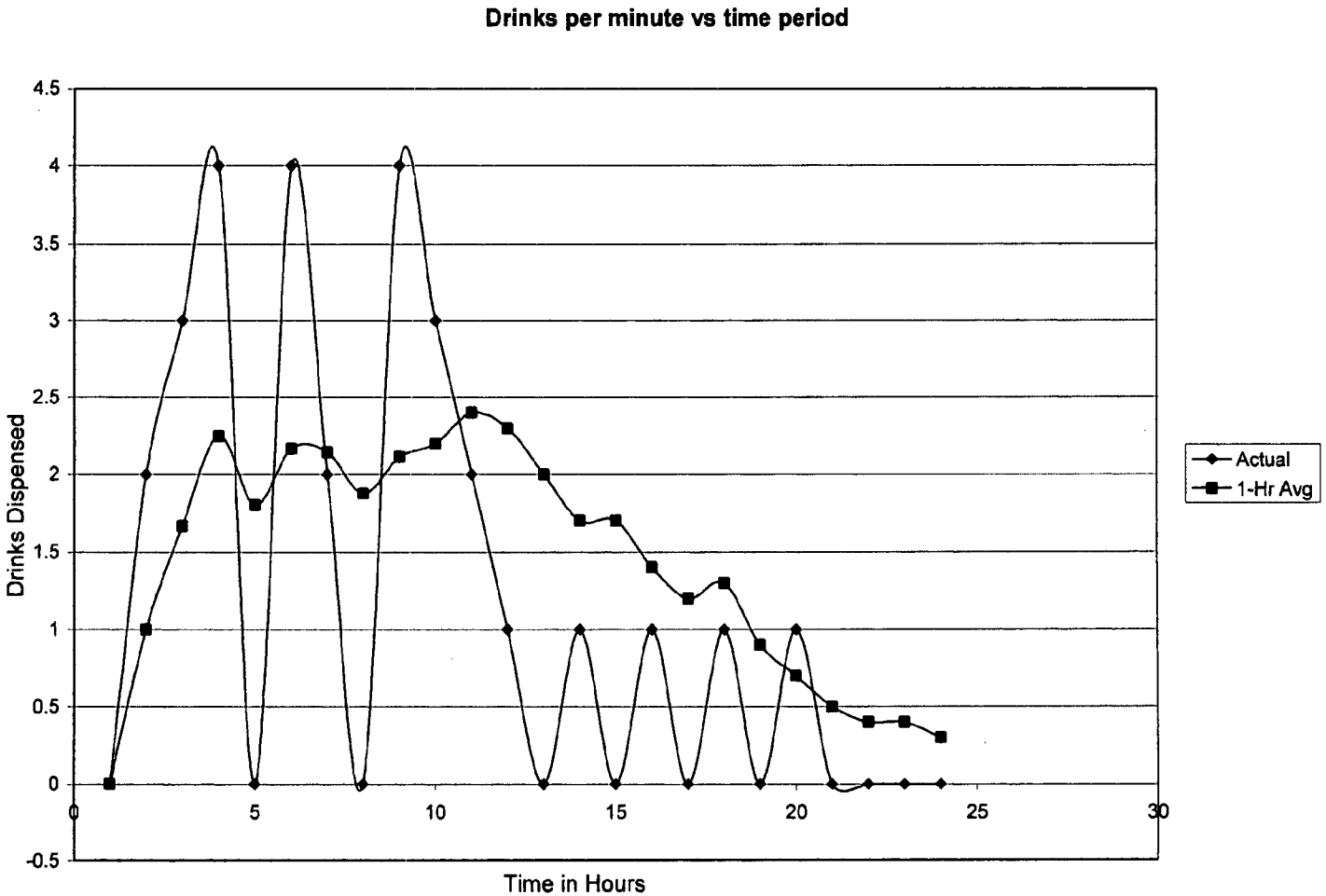
FIG. 5 is a graph of actual and 1-hour average drinks served per minute versus time for a frozen beverage product machine.
Figure 6:
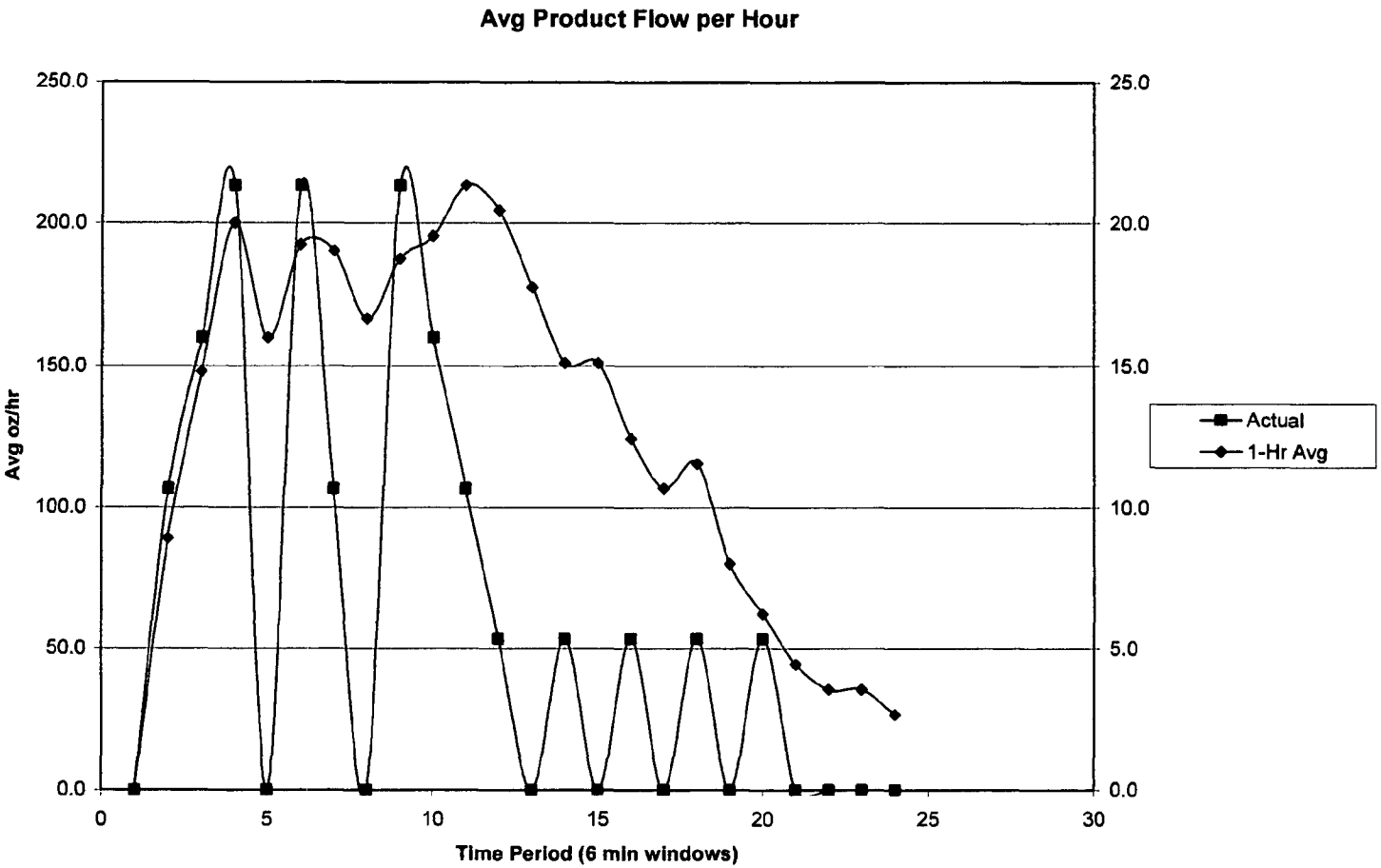
FIG. 6 is a graph of actual and 1-hour average product flow versus time for a frozen beverage product machine.

Another technique for monitoring beverage product throughput is shown in FIG. 5, which graphically illustrates a representative example of drinks drawn per minute versus time. Since the average size of a drawn drink is either fixed or known, based upon the number of drinks drawn over time, product throughput may readily be determined. FIG. 6 graphically shows a representative example of average beverage product flow per hour, which may be determined by brix valve on-time or by the number of beverages drawn during the time.

Product throughput being the primary factor or variable parameter that is used to adjust the value of the time tD until the next defrost cycle, the other variable parameters that affect the value of tD to a lesser extent are used to "fine tune" the value. In this connection, the viscosity of beverage product in a freeze barrel, the brix settings that determine the water/syrup ratio of beverage product delivered to a freeze barrel, product type, ambient temperature, power supply frequency, etc., may be and advantageously are used to add to or subtract from the time tD between defrost cycles, but to a lesser extent than does product throughput. The significance of each to the need for, or the lack of a need for, a defrost cycle is weighted appropriately, so that when the collective result is used to determine the time tD between defrost cycles, the time interval is correctly calculated based upon empirical test experience.

Three of the variable parameters, product type, ambient temperature and power supply frequency, normally either remain fixed or change only insignificantly once a frozen beverage product machine is installed at a particular location. These particular parameters are therefore entered as fixed values as part of commissioning a machine for service when the machine is first installed. The remaining parameters (other than product throughput) have values that can and do change in accordance with new information gathered at each defrost, and these may be considered "dynamic modifiers".

Product throughput, which has the greatest influence on and can charge the value of tD the most, is determined for a freeze barrel by the total time of actuation or total on-time, during a one hour period, of a pair of brix valves that deliver product to that freeze barrel. The total opportunity for delivery of product to the freeze barrel, i.e., the maximum amount of on-time of the pair of brix valves during the one hour period, is 3600 seconds. Above some threshold of on-time, product throughput is sufficiently great that no defrost cycles are required. However, as the on-time of the brix valves decreases, defrost cycles will be required more and more frequently, and when the on-time of the valves approaches 1% of the maximum possible on-time, defrost cycles will be required at least every three hours.

As product throughput exceeds the minimum requirement, the time between defrost cycles is extended. As the on-time of the brix valves exceeds a higher threshold, say 3% of the maximum opportunity time of 3600 seconds, then the time between defrost can be extended to once per day, or once every 24 hours, and advantageously can be scheduled to occur only after the machine comes out of the "sleep" mode and is prepared for startup, so that the defrost cycle occurs at a time when service of beverages to customers will not be interrupted.

An adaptive defrost algorithm, as implemented by a CPU (FIG. 13), is responsive to the values of the variable parameters to determine the time delay tD from one defrost cycle to the next. A default time delay period Td is provided to proscribe the time tD between defrost cycles, and is contemplated to be adjustable from 1.5 to 3.5 hours or more to allow a sliding time scale to be resorted to and used to compensate for any inaccuracies as may occur in the fundamental algorithm. The default time delay Td can also be used to adjust for significant differences between different syrups, which may require fundamentally different times between defrosts. It is anticipated, however, that the minimum default time Td be no less than 2 hours, irrespective of the time tD derived by the algorithm in response to the then occurring values of the variable parameters.

To initialize operation of a frozen beverage machine, preliminary information based upon then known operating conditions is entered into the CPU of the machine at the time the unit is commissioned, to automatically set the default time Td for the time between defrost cycles. The particular parameters that are then known and entered are:

| Parameter | Choices | Effect on the Time between Defrosts |
|---|---|---|
| Product type | Sugar-based or diet | Sugar-based products require less frequent defrosts, while diet syrups require more frequent defrosts. |
| Ambient temperature | The temperature, 75° F., 90° F., or 105° F., that most closely approximates the operating environment is selected | A higher ambient temperature requires more frequent defrost cycles than does a lower ambient temperatures. |
| Power supply frequency | 220 VAC, 60 Hz or 220 VAC, 50 Hz | 50 Hz applications require 16% more defrost time, but since the cooling system will have 16% less capacity, less frequent defrost cycles are required |

Once the frozen beverage product machine is commissioned, the adaptive defrost control algorithm becomes determinative of the time tD between defrost cycles and the primary parameter in arriving at that time then becomes product throughput. However, for the algorithm to be effective, initial conditions when the machine is started at the end of sleep mode must be such that a beverage product freezing cycle begins with a beater assembly and freeze barrel of the machine being free of ice. If they are not, the adaptive defrost algorithm will fail to work as intended, since in arriving at a value of tD, an assumption made is that the freeze barrel and beater assembly are initially in an ice free state. A programmed defrost is therefore made to occur for a minimum of two minutes when the machine leaves the sleep mode, to ensure that there is not a partial ice buildup in the freeze barrel and on the beater assembly that would preclude successful operation of the algorithm in deriving the time delay tD until occurrence of a defrost cycle.

The adaptive defrost control algorithm may be expressed generally as follows:

$$NDt=LDt+tD$$

where:

NDt=the time of day of the next defrost period;

LDt=the time of day of the last defrost period; and $tD=Dt+A\cdot(7.25-tT1)+B\cdot(Tmax-Y)+C\cdot(4-VISC)+D\cdot(BRIX-13)$=the time between defrost cycles and where:

tT1=time to reach the freeze barrel evaporator outlet temperature in last defrost;

Tmax=maximum evaporator outlet temperature achieved in last defrost;

Y=ending temperature control limit, e.g. 42° F.;

VISC=viscosity set point for the barrel, adjustable from 1 to 9;

BRIX=Brix set point for the barrel, where 13 is typical for sugar-based product;

A, B, C and D are coefficients.

The time in which to complete a defrost cycle is compared to a target time Tt. If the time duration of a defrost cycle reaches the target time Tt, and if at that time the temperature of refrigerant leaving the freeze barrel evaporator 42 or 46 has not risen sufficiently to indicate that defrost has been completed, the defrost may not have been adequate. In that case, the time interval tD until the next defrost cycle is reduced slightly to reduce the amount of ice buildup in the freeze barrel that can occur prior to the beginning of the next defrost cycle. On the other hand, if the time to reach the requisite evaporator outlet temperature in the previous defrost was less than the target time Tt, which may, for example, have a value on the order of about 7.25 minutes, then the time between defrosts tD may be increased.

In the above formula for the time tD between defrost cycles, the coefficient "A" is a modifier that determines the weight to be given to the term (7.25−tT1) in the adjustment of tD. If the defrost cycle extends beyond the target time Tt, for failure of the evaporator outlet to reach the requisite temperature by the end of the time Tt, the defrost cycle will be terminated by a default timer set to a greater time, such for example as 8 minutes.

The requisite or expected freeze barrel evaporator outlet temperature that should be achieved by the end of a defrost cycle may be on the order of about 50° F., but can be lower, such as 40° or 42° F. If the evaporator outlet temperature exceeds the requisite value at the target time Tt, then the time tD until the next defrost is increased. However, if the requisite evaporator outlet temperature is not achieved and the timer times out, then the time tD is decreased. In the above formula for the time tD until the next defrost cycle, the coefficient "B" is a modifier that determines the weight to be given to the term (Tmax−Y) in the correction of Tt.

If the VISC set point is greater than 4, then the time tD until the next defrost cycle is shortened slightly. If the VISC set point is less than 4, then time tD is extended slightly. In the above formula for the time tD, the coefficient "C" is a modifier used to determine the weight to be given to the term (4−VISC) in the adjustment of tD.

The final modifier is the BRIX setting, i.e., the setting of a pair of brix valves to determine the water/syrup ratio of the beverage components delivered to the freeze barrel. If set at 13, no adjustment of the time tD is required. However, if set lower, the time between defrost cycles is decreased, and if set higher, the time between defrost cycles is increased. In the above formula for the time tD, the coefficient "D" is a modifier used to determine the weight to be given to the term (BRIX−13) in the adjustment of tD.

The adaptive defrost control of the invention is provided with an auto drive error recovery, which reviews daily trading profiles and black out periods to determine if a freeze barrel should be forced into a defrost cycle following a system error, even though the time tD has not lapsed, followed by an auto drive reset of the adaptive defrost control.

Figure 7:
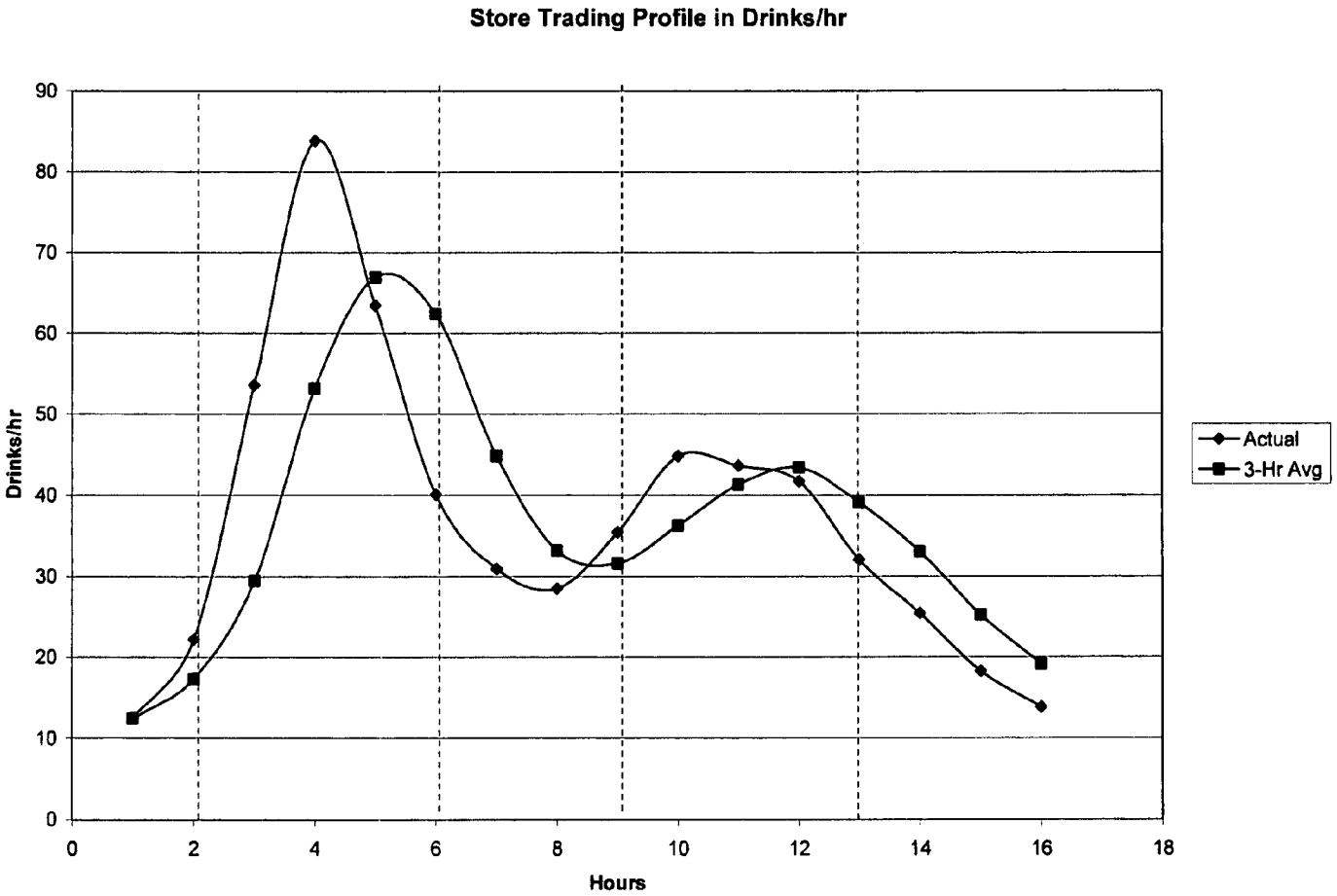
FIG. 7 is a graph of a typical store trading profile of actual and 3-hour average drinks served per hour versus time for a frozen beverage product machine.
Figure 8:
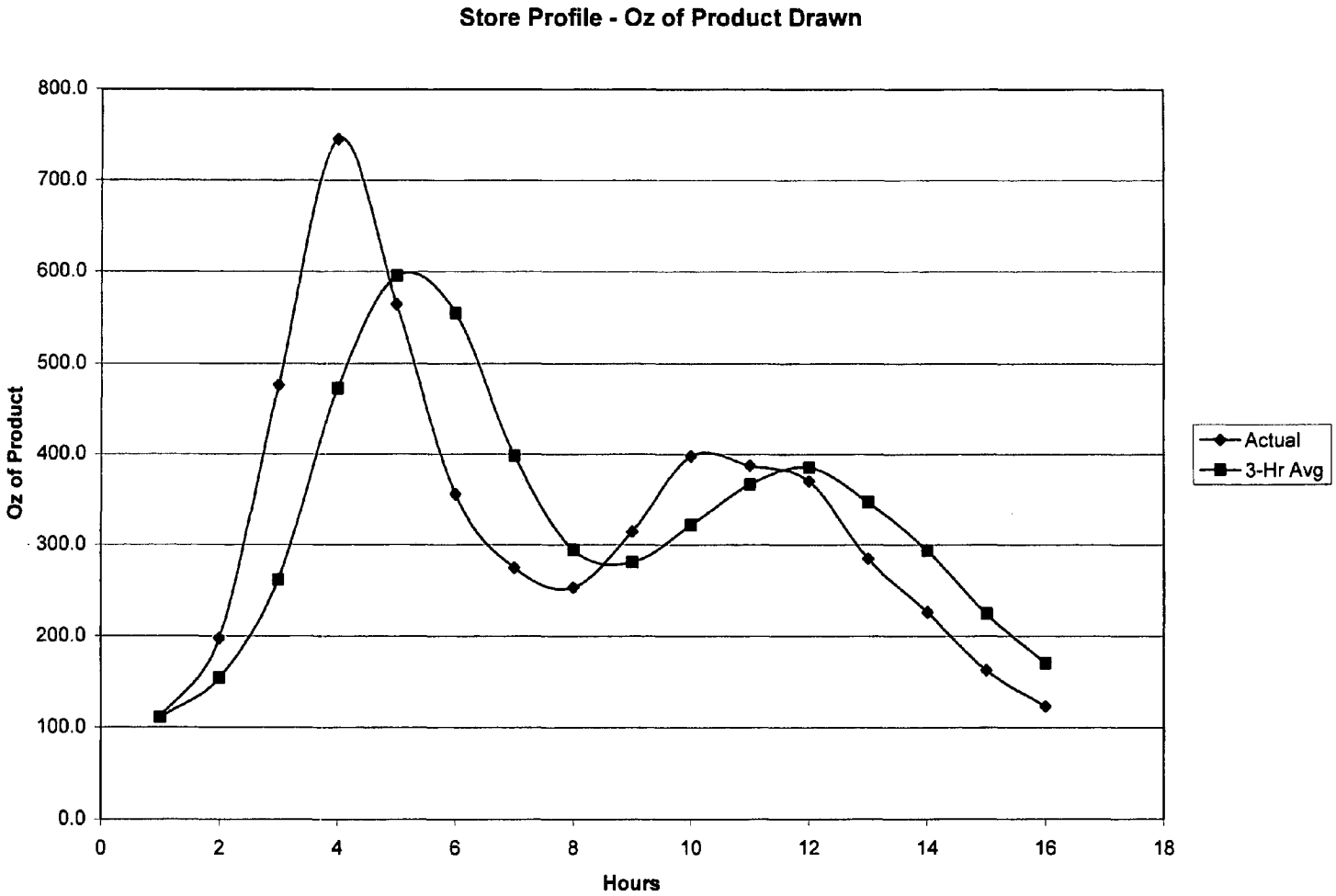
FIG. 8 is a graph of a typical store trading profile of actual and 3-hour average ounces of product drawn versus time for a frozen beverage product machine.
Figure 9:
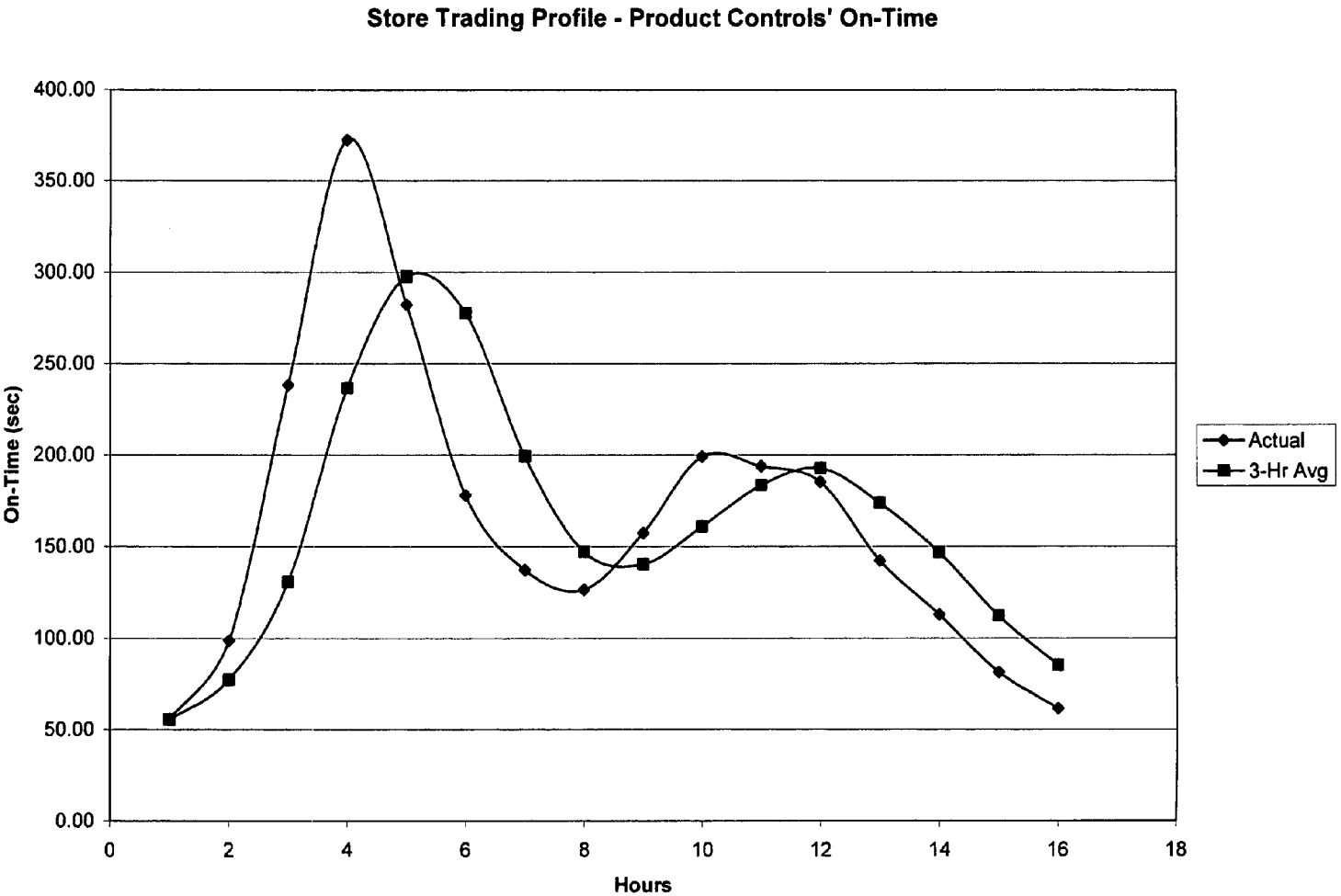
FIG. 9 is a graph of a typical store trading profile of actual and 3-hour average brix valve on-time versus time for a frozen beverage product machine.
Figure 10:
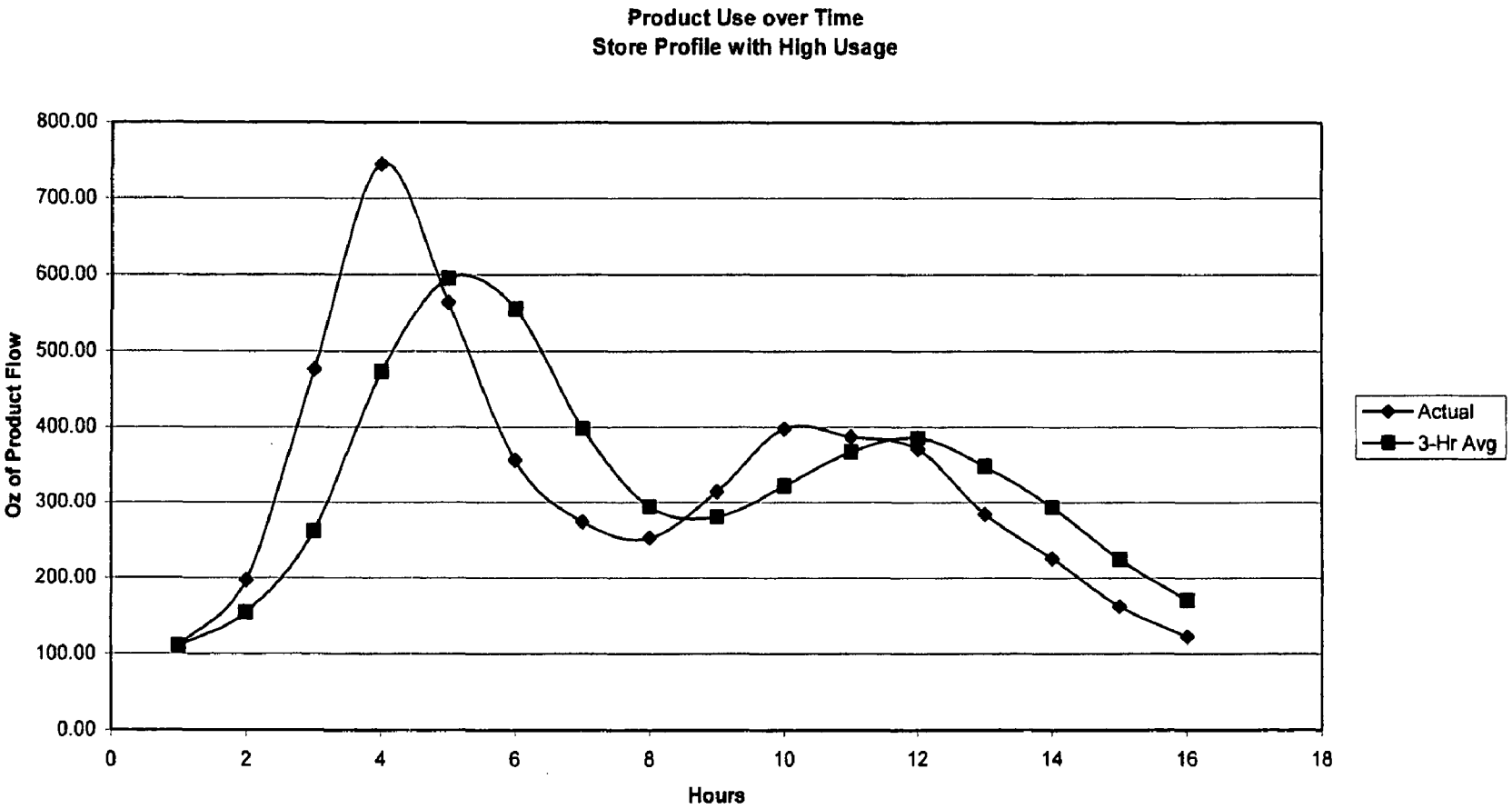
FIG. 10 is a graph of a typical store profile of actual and 3-hour average product use versus time for a frozen beverage product machine.

FIG. 7 is graphically shows a representative store or user trading profile of frozen beverage products dispensed per hour, with blackout time periods (not shown) being pre-assigned and during which blackout times a defrost cycle is prevented from occurring. FIG. 8 is along the lines of FIG. 7, and graphically shows a representative store or user trading profile of ounces of frozen beverage products dispensed per hour. FIG. 9 graphically shows a representative store or user trading profile of brix valve on-time per hour, and FIG. 10 shows a representative store profile of ounces of product used over time.

Figure 11:
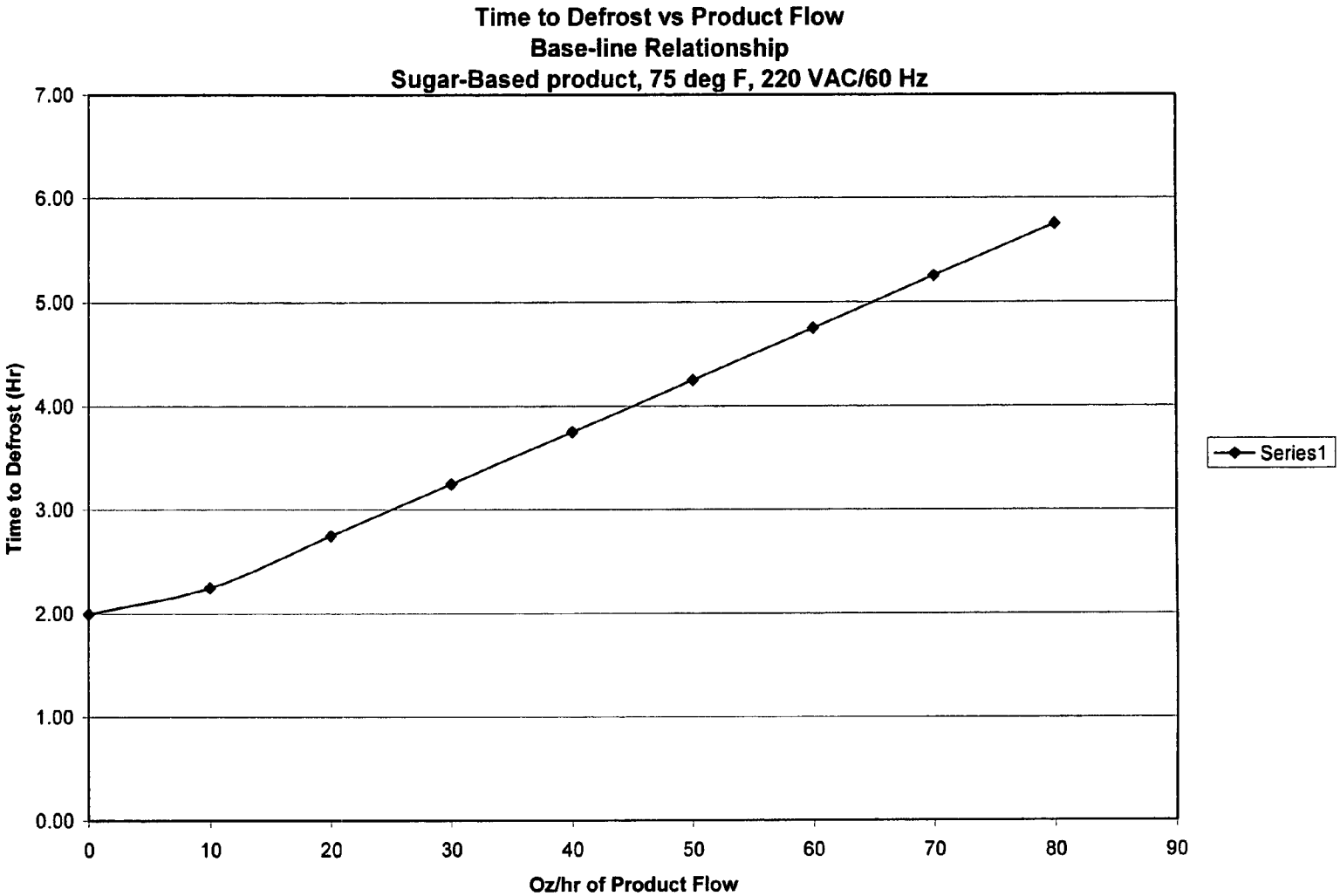
FIG. 11 is a graph of time to a defrost cycle versus product flow for a frozen beverage product machine.

FIG. 11 graphically shows a representative relationship of the time interval tD to the next defrost cycle versus product throughput to a freeze barrel for a sugar-based beverage product supplied at 75° F. and with a 220 VAC/60 HZ power supply. When product throughput drops to about 25 ounces per hour, a defrost cycle is required every 3 hours, and when product throughput is at least about 80 ounces per hour, no defrost cycles are required.

Figure 12:
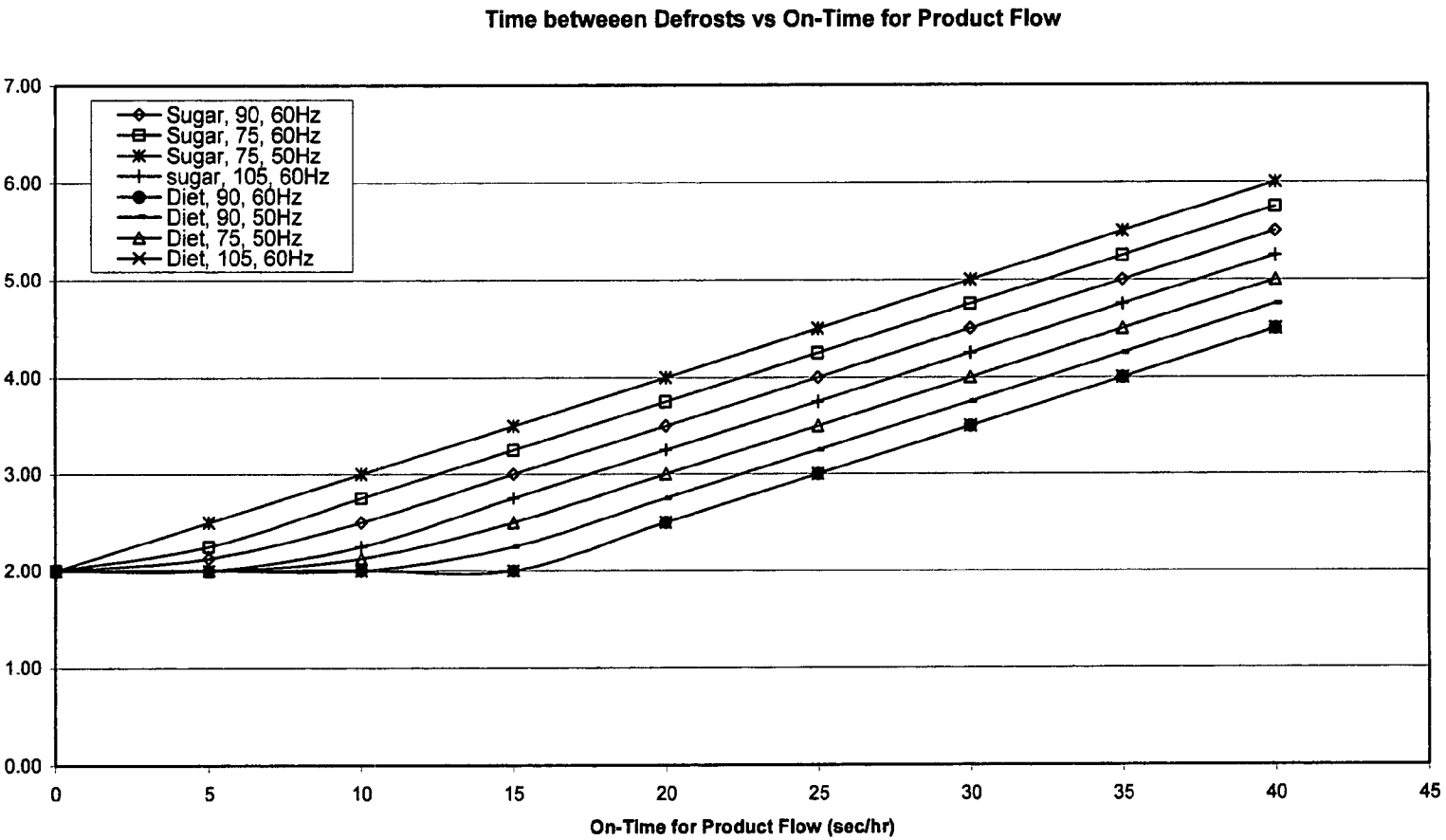
FIG. 12 is a graph of time between defrost cycles versus brix valve on time for a frozen beverage product machine for various types of beverage products.

FIG. 12 is a graphically represents typical times tD between defrost cycles versus on-time of brix valves for product delivered to a freeze barrel, for various types of beverage products.

Figure 13:
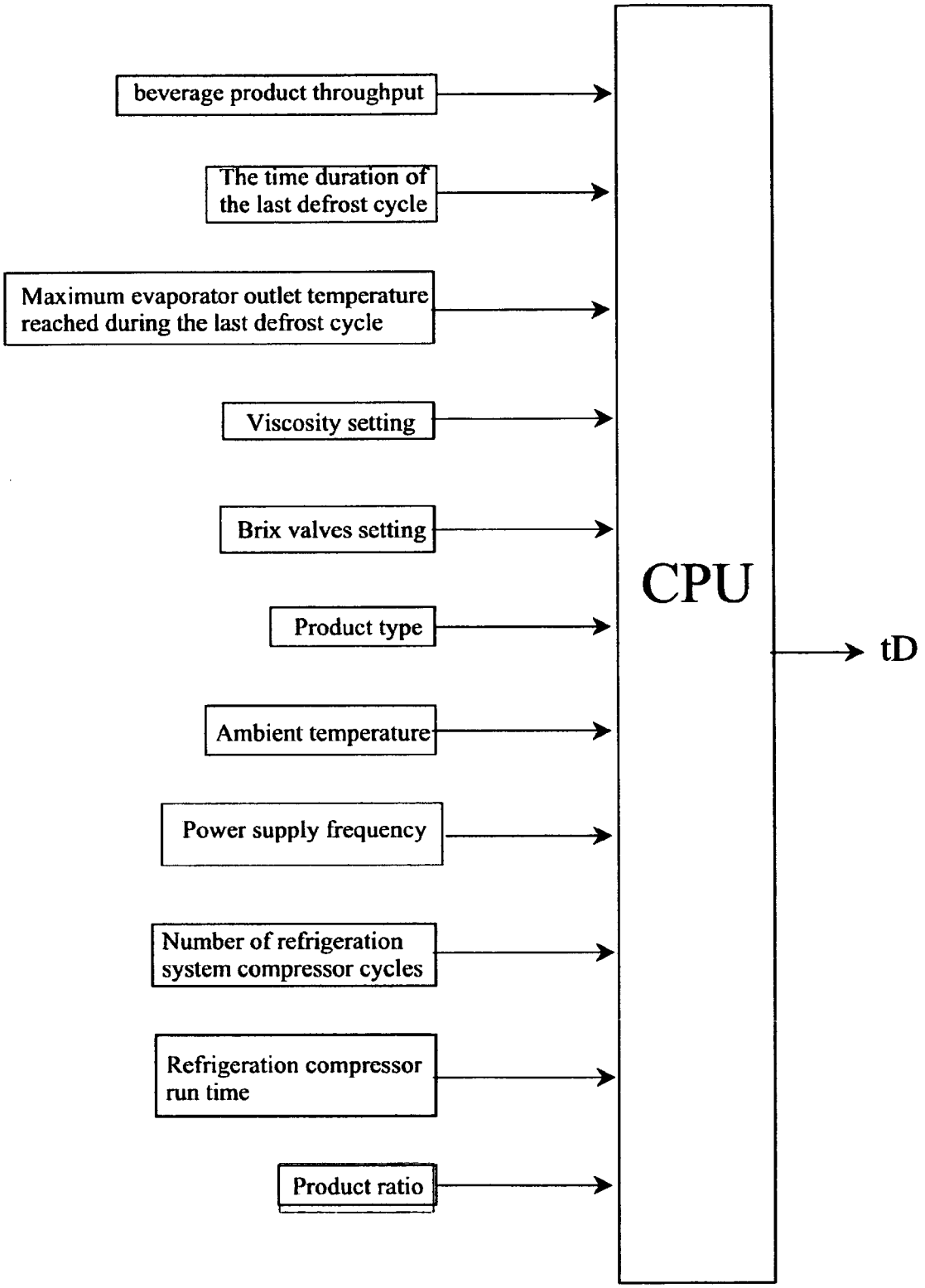
FIG. 13 is a schematic representation of a CPU for implementing an adaptive defrost control algorithm according to the teachings of the invention.

FIG. 13 shows a CPU as may be utilized in implementation of the invention to derive values of the time intervals tD between defrost cycles.

It is to be understood that all values shown in charts or recited in the description of the invention are for illustrative purposes only, and are not necessarily those as may be used or required in implementation of the adaptive defrost control with any particular frozen beverage product machine. Instead, the values are empirically derived for any specific embodiment of frozen beverage product machine, and may and normally do change from one embodiment of machine to another.

The invention thus provides an adaptive defrost control for a frozen beverage product machine, which adjusts the time interval tD between defrost cycles in a manner to defrost a freeze barrel only as necessary and only on an as-needed basis. In determining the extent and direction of the adjustment to be applied to the time tD, the adaptive defrost control monitors a set of parameters of the frozen beverage product machine and adjusts the time tD in accordance with a concurrence or correlation of the values of a selected one or more of the parameters. In this manner, the invention advantageously maximizes uptime of the machine. It is understood, of course, that the invention is applicable for use with other types of frozen product dispensers, such for example as ice cream makers and dispensers.

While the invention has been described in terms of defrosting a freeze barrel by operating a refrigeration system for the freeze barrel in a defrost cycle, the invention also contemplates using a refrigeration system to chill a freeze barrel, but defrosting the freeze barrel by means of an electric heater in heat exchange relationship with the freeze barrel. For this embodiment, the time between operation of the electric heater is variably controlled in accordance with the need for defrost of the freeze barrel.

While embodiments of the invention have been described in detail, various modifications and other embodiments thereof may be devised by one skilled in the art without departing from the spirit and scope of the invention, as defined in the appended claims.

What is claimed is:

1. A frozen product dispenser, comprising:

a freeze barrel;

means for delivering liquid product into said freeze barrel;

a refrigeration system operable in chilling cycles to freeze product in said freeze barrel;

means for dispensing frozen product from said freeze barrel;

means for defrosting said freeze barrel;

means for monitoring the values of at least two variable parameters of said frozen product dispenser that are each representative of a need to defrost said freeze barrel; and means responsive to the values of at least two of said parameters for initiating operation of, and for adaptively adjusting the times of operation of, said defrosting means in defrost cycles, wherein the value of product throughput comprises one of said at least two variable parameters to which said initiating and adjusting means is responsive to adaptively adjust said time interval tD between the end of one defrost cycle and the beginning of the next defrost cycle of said defrosting means, such that as product throughput increases, tD is decreased, and as product throughput decreases, tD is increased.

2. A dispenser as in claim 1, wherein said defrosting means comprises means for operating said refrigeration system in defrost cycles.

3. A dispenser as in claim 1, wherein said defrosting means comprises an electric heater for defrosting said freeze barrel in defrost cycles.

4. A dispenser as in claim 1, wherein the other of said at least two variable parameters comprises at least one of: (1) the time duration of the last defrost cycle; (2) the maximum temperature reached at an outlet from an evaporator of said refrigeration system during the last defrost cycle; (3) the viscosity of product in said freeze barrel; (4) the type and composition of liquid product delivered into said freeze barrel; (5) the ambient temperature; (6) the frequency of electric power supplied to operate the refrigeration system; (7) the frequency that a compressor of said refrigeration system operates in chilling cycles; and (8) the time for which said refrigeration compressor runs during chilling cycles.

5. A dispenser as in claim 1, wherein said initiating and adjusting means, in response to the value of the at least one other of the at least two variable parameters to which it is responsive, adjusts tD by a lesser amount than it does in response to the value of product throughput.

6. A dispenser as in claim 1, wherein said initiating and adjusting means is responsive to a value of product throughput above a predetermined value to inhibit operation of said defrosting means.

7. A dispenser as in claim 1, wherein said initiating and adaptively adjusting means initiates operation of said defrosting means in a defrost cycle upon lapse of a default time Td from the end of the last defrost cycle, irrespective of the values of said at least two variable parameters.

8. A dispenser as in claim 1 wherein said means for initiating and adaptively adjusting operates according to the algorithm:

$$NDt=LDt+tD$$

where:

NDt=the time of day of the next defrost period;

LDt=the time of day of the last defrost period; and tD=Dt+A·(7.25−tT1)+B·(Tmax−Y)+C·(4−VISC)+D·(BRIX−13)=the time between the last and the next defrost cycles, and where:

tT1=the time required to reach a selected outlet temperature of a freeze barrel evaporator during the last defrost cycle;

Tmax=the maximum freeze barrel evaporator outlet temperature achieved during the last defrost cycle;

Y=an evaporator outlet temperature control limit that terminates a defrost cycle;

VISC=a selected product viscosity set point for said freeze barrel;

BRIX=a brix set point for said freeze barrel representative of the ratio of components of the liquid product delivered into said barrel; and A, B, C and D are coefficients.

9. A dispenser as in claim 1, wherein said means for initiating and adaptively adjusting is responsive to the time required to complete a current defrost cycle of said freeze barrel being greater than a target time Tt to decrease said time interval tD until the next defrost cycle, and is responsive to the time required to complete a current defrost cycle of said freeze barrel being less than said target time Tt to increase said time interval tD until the next defrost cycle.

10. A method of operating a frozen product dispenser, comprising the steps of:

delivering liquid product into a freeze barrel;

operating a refrigeration system in chilling cycles to freeze product in the freeze barrel;

dispensing frozen product from the freeze barrel;

defrosting the freeze barrel;

sensing the values of at least two variable parameters of the frozen product dispenser that are each representative of a need to perform said defrosting step; and controlling and adaptively adjusting the times between performance of said defrosting step in accordance with the sensed values of at least two of the parameters, wherein the value of product throughput comprises one of the at least two variable parameters to which said controlling and adaptively adjusting step is responsive to adaptively adjust the time interval tD between the end of one performance of said defrosting step and the beginning of the next performance of said defrosting step, such that as product throughput increases, tD is decreased, and as product throughput decreases, tD is increased.

11. A method as in claim 10, wherein said defrosting step comprises operating the refrigeration system in defrost cycles.

12. A method as in claim 10, wherein said defrosting step comprises operating an electric heater to defrost the freeze barrel.

13. A method as in claim 10, wherein the other of the at least two variable parameters sensed by said sensing step comprises at least one of: (1) the time duration of performance the last defrosting step; (2) the maximum temperature reached at an outlet from an evaporator of the refrigeration system during performance of the last defrosting step; (3) the viscosity of product in the freeze barrel; (4) the type and composition of liquid product delivered into the freeze barrel by said delivering step; (5) the ambient temperature; (6) the frequency of electric power supplied to operate the refrigeration system; (7) the frequency of operation of a compressor of the refrigeration system in chilling cycles; and (8) the time for which the refrigeration compressor runs during chilling cycles.

14. A method as in claim 10, wherein wherein said controlling and adjusting step, in response to the value of the at least one other of the at least two variable parameters to which it is responsive, adjusts tD by a lesser amount than it does in response to the value of product throughput.

15. A method as in claim 10, wherein said controlling and adjusting step is responsive to a value of product throughput above a predetermined value to inhibit operation of said defrosting step.

16. A method as in claim 10, wherein said controlling and adaptively adjusting step initiates performance of said defrosting step upon lapse of a default time Td from the end of performance of the last defrosting step, irrespective of the values of the at least two variable parameters.

17. A method as in claim 10, wherein said controlling and adaptively adjusting step operates according to the algorithm:

$$NDt=LDt+tD$$

where:

NDt=the time of day for performance of the next defrosting step;

LDt=the time of day when performance of the last defrosting step ended; and tD=Dt+A·(7.25−tT1)+B·(Tmax−Y)+C·(4−VISC)+D·(BRIX−13)=the time between termination of performance of the last defrosting step and initiation of performance of the next defrosting step, and where:

tT1=the time required to reach a selected outlet temperature of a freeze barrel evaporator during performance of the last defrosting step;

Tmax=the maximum sensed evaporator outlet temperature achieved during performance of the last defrosting step;

Y=an ending evaporator outlet temperature control limit;

VISC=a selected product viscosity set point for the freeze barrel;

BRIX=a brix set point for the freeze barrel representative of the ratio of components of the liquid product delivered into the barrel; and A, B, C and D are coefficients.

18. A method as in claim 10, wherein said controlling and adaptively adjusting step is responsive to the time required to complete performance of a current defrosting step being greater than a target time Tt to decrease the time interval tD until performance of the next defrosting step, and is responsive to the time required to complete performance of a current defrosting step being less than the target time Tt to increase the time interval tD until performance of the next defrosting step.

* * * * *